US011156027B1

(12) United States Patent
Ford

(10) Patent No.: US 11,156,027 B1
(45) Date of Patent: Oct. 26, 2021

(54) FRAME SYSTEMS FOR SEALING WINDOW FILMS

(71) Applicant: SerraLux Inc., Los Gatos, CA (US)

(72) Inventor: Robert Somers Ford, Los Gatos, CA (US)

(73) Assignee: SerraLux Inc., Los Gatos, CA (US)

( * ) Notice: Subject to any disclaimer, the term of this patent is extended or adjusted under 35 U.S.C. 154(b) by 0 days.

(21) Appl. No.: 16/688,943

(22) Filed: Nov. 19, 2019

Related U.S. Application Data

(60) Provisional application No. 62/770,655, filed on Nov. 21, 2018.

(51) Int. Cl.

| | |
|---|---|
| ***E06B 3/28*** | (2006.01) |
| ***E06B 3/58*** | (2006.01) |
| ***E06B 3/56*** | (2006.01) |
| ***E06B 3/26*** | (2006.01) |

(52) U.S. Cl.
CPC ..... *E06B 3/285* (2013.01); *E06B 3/56* (2013.01); *E06B 3/5814* (2013.01); *E06B 3/2605* (2013.01)

(58) Field of Classification Search
CPC ..... E06B 3/285; E06B 3/5814; E06B 3/2605; E06B 3/56; E06B 2003/6638; E06B 3/677; E06B 7/10
See application file for complete search history.

(56) References Cited

U.S. PATENT DOCUMENTS

| | | | | |
|---|---|---|---|---|
| 4,856,243 | A * | 8/1989 | Ault | E06B 3/677 52/209 |
| 4,984,402 | A * | 1/1991 | Davies | E06B 3/22 52/204.593 |
| 5,937,611 | A * | 8/1999 | Howes | B32B 17/10036 156/99 |
| 6,055,783 | A * | 5/2000 | Guhl | C03C 27/06 156/109 |
| 7,815,997 | B2 | 10/2010 | Reuter | |
| 2005/0129395 | A1 * | 6/2005 | Sabac | G03B 17/26 396/517 |
| 2008/0155911 | A1 | 7/2008 | Reuter | |
| 2010/0272928 | A1 * | 10/2010 | Colton | B32B 17/067 428/12 |
| 2020/0199932 | A1 * | 6/2020 | Jones | E06B 1/02 |

FOREIGN PATENT DOCUMENTS

| | | | | |
|---|---|---|---|---|
| GB | 2161526 | A * | 1/1986 | E06B 3/285 |

* cited by examiner

*Primary Examiner* — Brian D Mattei
*Assistant Examiner* — Omar F Hijaz
(74) *Attorney, Agent, or Firm* — Edward S. Sherman

(57) ABSTRACT

Exposed edge margins that are formed when a window film is installed on a glazing surface using an aqueous fluid as a lubricant are immediately covered by a series of elongated members that adhere to one or more of the window film or the surrounding frame. The elongated members provide concealed gaps or channels that allow for the slow evaporation of the aqueous fluid as the adhesive on the window film slowly wets and develops maximum bond strength to the glazing surface. The elongated members are preferably left in place as an inner frame. The inner frame device and method can be deployed in attached an light control film to a window, such as UV protective film, IR rejecting film, absorbing film and daylighting film.

13 Claims, 8 Drawing Sheets

FIG. 1B
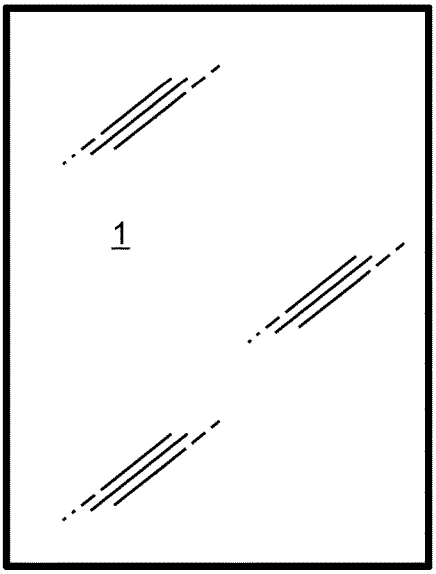
FIG. 1A
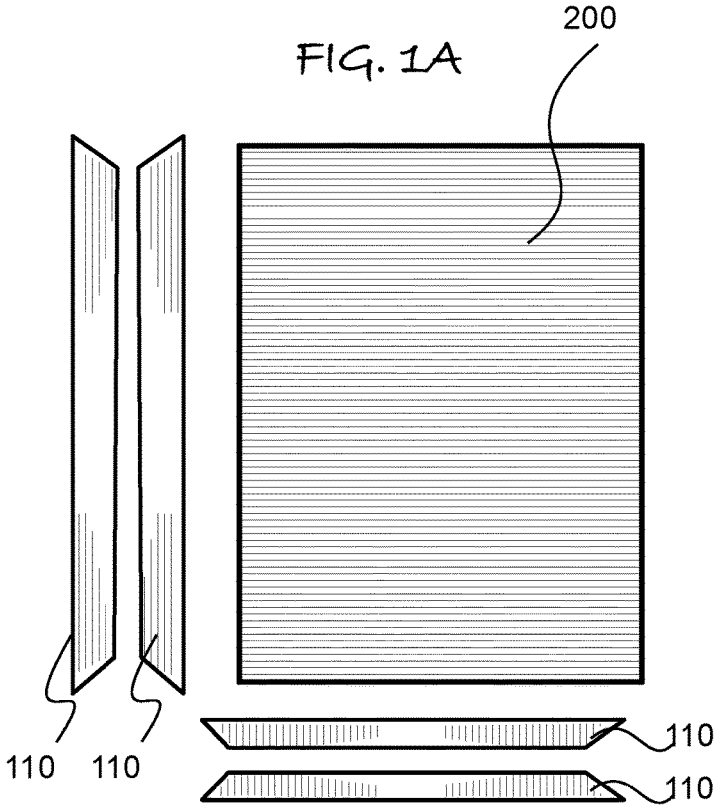
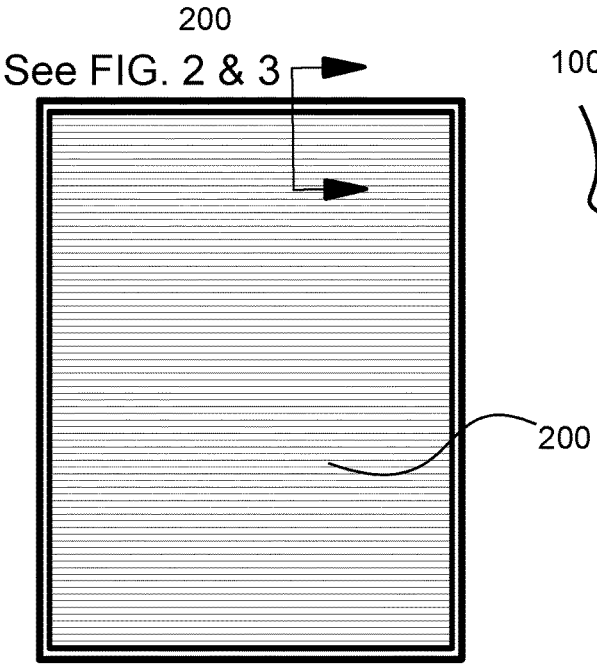
FIG. 1C
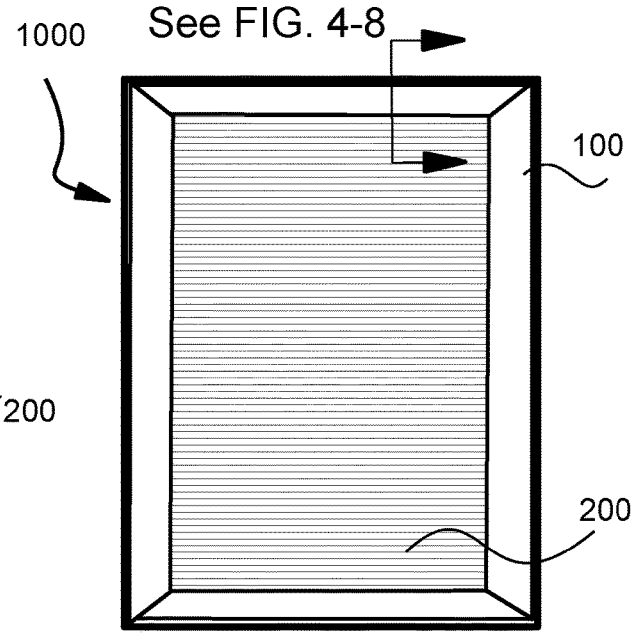
FIG. 1D

FRAME SYSTEMS FOR SEALING WINDOW FILMS

CROSS REFERENCE TO RELATED APPLICATIONS

The present application claims the benefit of priority to the US provisional patent of the same title having application Ser. No. 62/770,655 that was filed on Nov. 21, 2018, and is incorporated herein by reference.

BACKGROUND OF INVENTION

The field of inventions is the installation of light control films on window glazing, and more particularly glazing on homes, building and dwellings.

Objectives of the invention are to facilitate the installation process and provide a uniform high quality appearance with one or more of faster installations, lower levels of installer skill, a more uniform appearance despite adverse impediments in quality of the glazing installation, such as variances in the size and locations of edge gaskets and adhesive beads.

The above and other objects, effects, features, and advantages of the present invention will become more apparent from the following description of the embodiments thereof taken in conjunction with the accompanying drawings

SUMMARY OF INVENTION

In the present invention, the first object is achieved by providing an interior window framing component that comprises an elongated member having a first side and a second side that is disposed orthogonally to the first side, in which the first and second sides are coupled together, an adhesive means disposed on at least one of the first and second sides, the adhesive means extending along the side in the direction of a primary axis of the elongated member, a plurality of channels for vapor egress when the adhesives are attached to a glazing surface and an adjacent orthogonal window frame member, the channels being generally disposed orthogonal to the primary axis of the elongated member and each channel extending from a first position between the adhesive on one side and a junction with other side to a second position on the other side that is between an edge of the other side and the adhesive disposed on the other side.

A second aspect of the invention is characterized by such an interior window framing component wherein the plurality of channels for vapor egress are formed by gaps between the adhesive disposed on a one side of the elongated member.

Another aspect of the invention is characterized by any such interior window framing component wherein the plurality of channels for vapor egress are formed in the elongated member.

Another aspect of the invention is characterized by any such interior window framing component wherein the adhesive means extends continuously on at least one side of the elongated member.

Another aspect of the invention is characterized by any such interior window framing component wherein the adhesive means extend continuously on both sides of the elongated member.

Another aspect of the invention is characterized by any such interior window framing component wherein the adhesive means is a pressure sensitive adhesive strip.

Another aspect of the invention is characterized by any such interior window framing component wherein the pressure sensitive adhesive strip has a series of gaps to define channels for moisture egress.

Another aspect of the invention is characterized a window with an attached covering film, the window comprising a glazing surface installed in a window frame, the window frame having inward extending sides disposed orthogonal to and generally surrounding the glazing surface, a window film installed over the glazing surface being installed with an adhesive materials disposed between at least a portion of the window film and the glazing surface, wherein the interior window framing component of claim 1 is installed about the frame to cover orthogonal and adjacent portions of the frame and at least a perimeter of the glazing surface that is not completely covered by the window film.

Another aspect of the invention is characterized by any such window with an attached covering film wherein the window film is a daylighting film.

Another aspect of the invention is characterized by any such window with an attached covering film wherein the adhesive is a pressure sensitive adhesive.

Another aspect of the invention is characterized by a process for installing a window film, the process comprising the steps of providing a flexible window film having a first side covered with a pressure sensitive adhesive applying an aqueous fluid to a window that is set within a frame, providing any such interior window framing, applying the first side of the flexible window film against the window such that the flexible window film can be one or more of laterally position and trimmed to substantially fill the frame, removing excess aqueous fluid from between the flexible window film and the window, installing the window frame component about the frame to cover orthogonal and adjacent portions of the frame and at least a perimeter of the window that is not completely covered by the flexible film.

Another aspect of the invention is characterized by a kit for installing window film, the kit comprising: an expanse of a window film having a first side covered by a pressure sensitive adhesive, in which the pressure sensitive adhesive is covered by a release film and any such interior window framing component.

The above and other objects, effects, features, and advantages of the present invention will become more apparent from the following description of the embodiments thereof taken in conjunction with the accompanying drawings.

BRIEF DESCRIPTION OF DRAWINGS

FIG. 1A illustrates in a front elevation view of a kit for window covering and FIG. 1B-D are front elevations showing the sequence of steps in applying the components of the kit to the window and frame.

DETAILED DESCRIPTION

Figure 2:
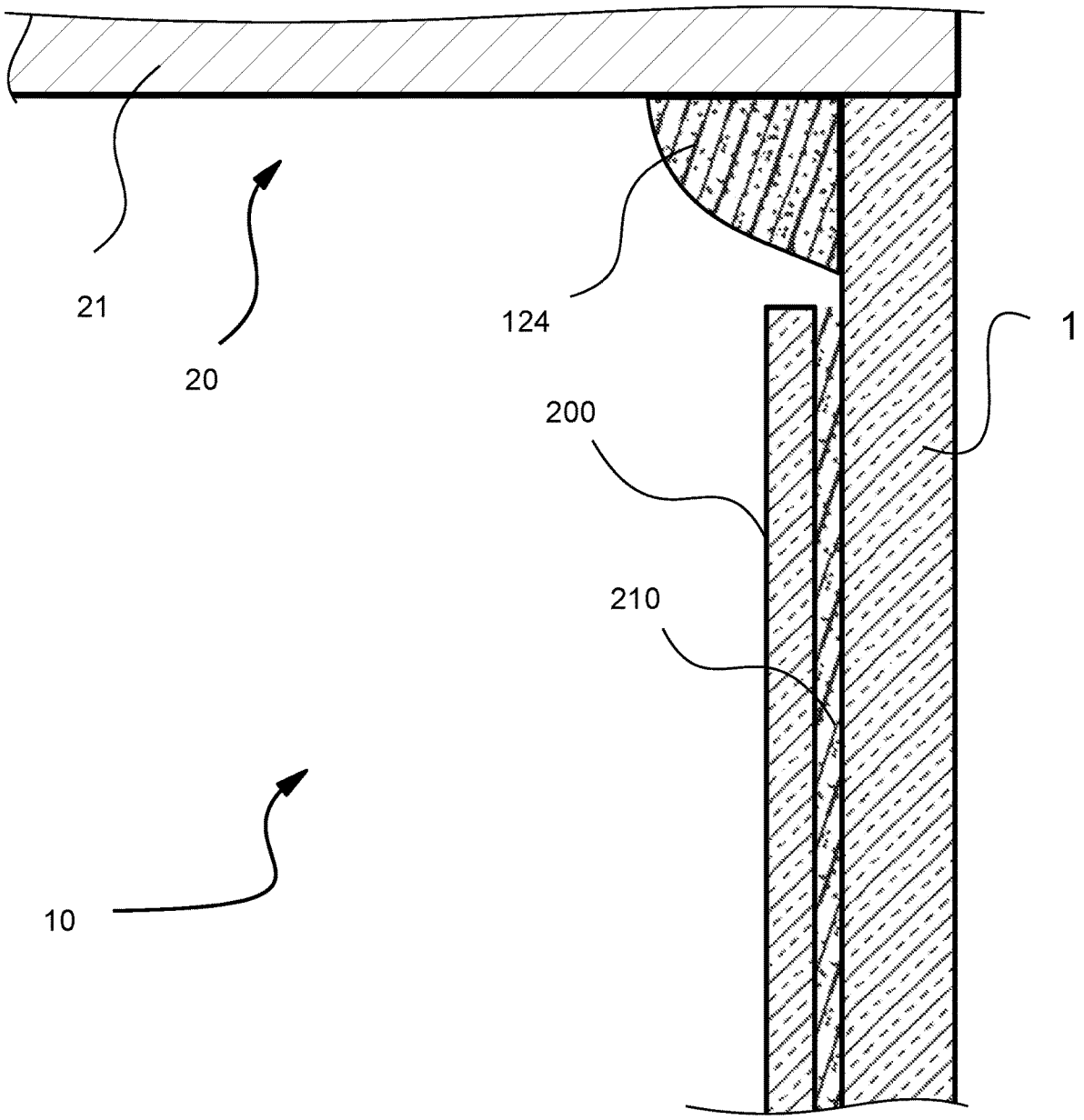
FIG. 2 is side cross-sectional elevation view of the window and frame with the film applied to the interior of the window with the adhesive.
Figure 3:
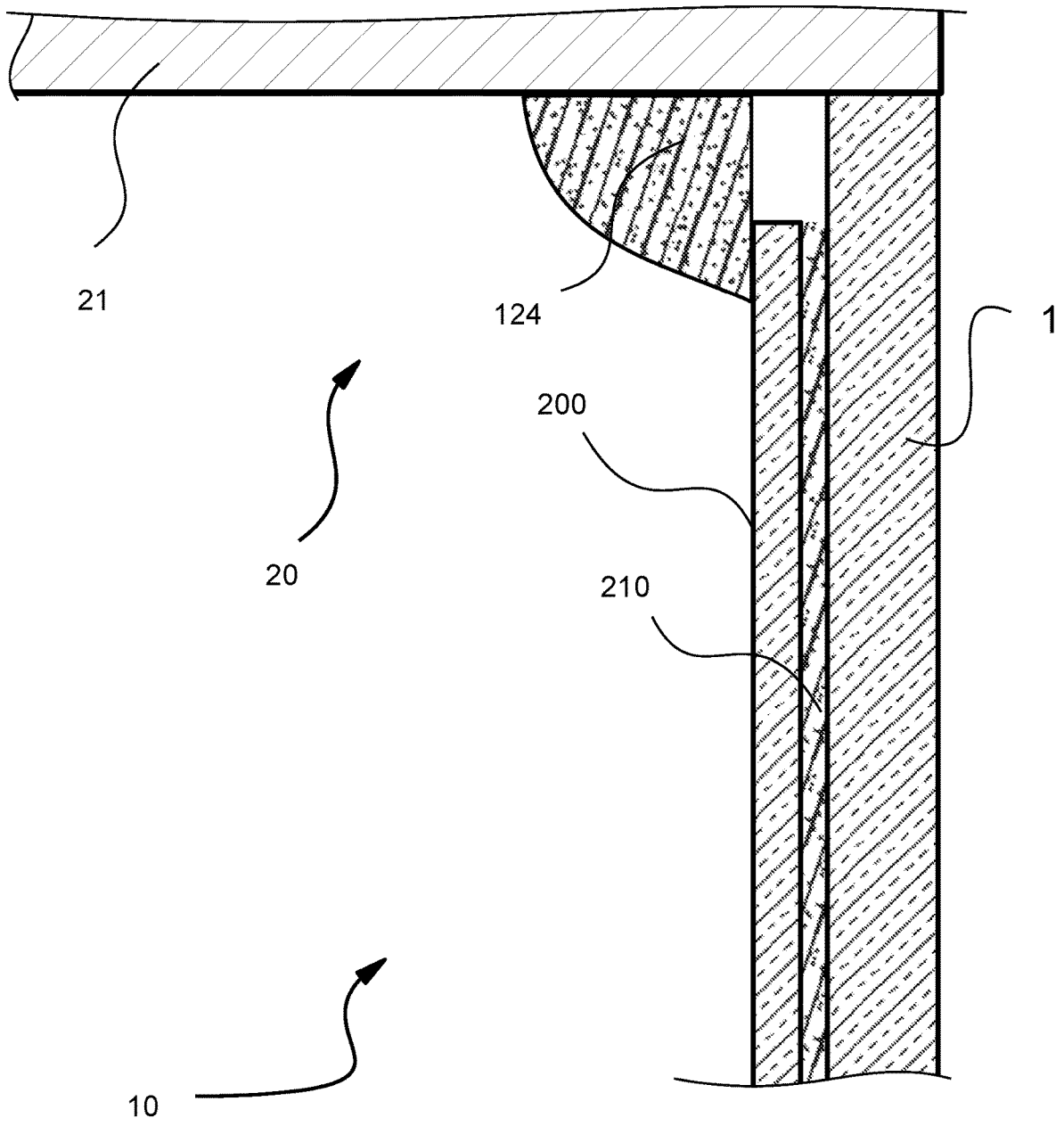
FIG. 3 is side cross-sectional elevation view of the window and frame with the film applied to the interior of the window with the adhesive, and an adhesive bead applied over the edge of the film at the window frame edge.

Referring to FIGS. 1A through 8, wherein like reference numerals refer to like components in the various views, there is illustrated therein a new and improved frame systems for sealing glazing applied window films 200, generally denominated 1000 herein.

The frame system 1000 is deployed on a window 10 with an attached covering film 200. The window 10 comprises a glazing surface 1 installed in a window frame 20. The window frame 20 has inward extending sides 21 disposed orthogonal to and generally surrounding the glazing surface 1.

The window covering film 200 is adhered to the window's glazing surface 1 interior side with a pressure sensitive adhesive 210. To avoid and eliminate air trapped on installation between the glazing 1 and the adhesive 210, a film or light mist of water is disposed between the glazing surface 1 and the adhesive 210 during installation. The water provides lubrication between the adhesive 210 and the glazing surface 1 so the film position can be adjusted after it is unrolled and laid against the planar glazing 1. To eliminate air pockets or bubbles, the water is slowly squeezed out with a flexible blade like instrument, i.e. a squeegee, with repeated sweeping motions to the side of the frame. The sweeping movement gathers the water that is clinging to the glazing as a mist or discontinuous film that is used to displace or drag any visible air bubbles to be expelled at the lateral edge of the film 200. A very thin film of water may remain or be physically adhered to the glazing and or the adhesive. This residual moisture between the glazing and adhesive will slowly diffuse outward to the window film edge, allowing "wetting" of the adhesive to the glazing so a stronger bond to forms between them, securing the window film 200 in place. However, the margin or edge of the film 200 may be uneven after installation, that is slightly skewed from cutting or trimming, or having uneven and wavy gaps at the sides, depending on the skill of the installer, as careful trimming to avoids such defects is time consuming and requires training and skill development. A bead of caulk or solid adhesive 124 may be applied around the edge of the film 200 to cover the corner at which the glazing 1 and extending frame sides 21 meet, hiding any uneven appearance. However, the adhesive bead 124 can only be installed weeks later after the water used in application of the film 200 has sufficiently diffused from the film 200 and adhesive 201 at the film 200 edges. The application of an adhesive bead 124 also requires considerable skill and time. The final application of the adhesive bead 124 is either disruptive to inhabitants, or delays building occupancy. It is also common for the adhesive bead 124 to be a factor applied component when some windows are manufactured and installed in a frame, without the application of the window film 200. In this case, the subsequent application of a film, such as a day lighting film, has to deal with the pre-installed adhesive bead 124, and may results in a second and larger adhesive bead that covers the first adhesive bead that was factory installed as well as the margin between it and the window film 200.

Various aspect of the inventive systems facilitate installation efficiency, but also allows for moisture egress so that the adhesive 210 can fully "wet" the glazing surface and reach a maximum bonding strength. It also avoids labor intensive trimming, removal and replacing of the window gaskets weeks or months after the window film is applied over the glazing. The resulting installed window film product has a consistently neat appearance that avoids visible exposed edge of the film, which are susceptible to peeling due to aging, misuse or vandalism.

It should be appreciated that by adhesive 201 "wetting" the glazing 1, we mean a sufficient diffusion of the water used in installation so the visco-elastic adhesive 210 can form a strong and direct bond to the glazing material. Even when detectable moisture has been removed, the adhesive bond may still increase in strength over time, depending on the nature of the adhesive. This increase in strength is also referred to as a curing process.

When the caulking or adhesive bead 124 was applied to the window 10 and frame 20 before the window film 200 is applied, then the placement of the window film 200 can be effected by the size and shape uniformity of the adhesive bead 124. More specifically, in FIG. 2, the adhesive bead 124 was applied at the corner and edges in which the frame side 21 meets the glazing 1 prior to the application of the film 200 on the glazing surface 1. In contrast, FIG. 3 the adhesive bead 124 was applied at the corner and edges in which the frame side 21 meets the glazing 1 after the application of the film 200 on the glazing surface 1. Hence, the adhesive bead 124 in FIG. 3 covers an edge portion of the window film 200.

FIG. 1A illustrates a kit 300 for installing window film 200 that generally comprises an expanse of a window film 200 having a first side covered by a pressure sensitive adhesive layer 210, in which the pressure sensitive adhesive 210 is covered by a release film. The kit 200 also includes the interior window framing components 100, which comprise a plurality of elongated member 110, each adapted for application to one side 21 of the window frame 20 to cover the adhesive beads 124 at the frame side 21 and glazing 1 corner. FIG. 2-8 illustrate several alternative embodiments of the elongated elements 110 as installed, with various modifications to accommodate the window frame 20 and the size of the adhesive bead 124.

In accordance with the present invention, the kit of FIG. 1A is used as generally illustrated in FIG. 1B-D in a process for installing a window film 200. The process comprises the steps of applying an aqueous fluid to a window 10 on glazing surface 1 and then placing the adhesive 210 side of the film 200 on the wet glazing 1. The flexible window film 200 is slid into the best alignment with the window glazing 1 and frame 20, and the excess water is removed with the flexible blade or squeegee. The flexible window film 200 can be one or more of laterally position and trimmed to substantially fill the frame either before or after removing excess aqueous fluid from between the flexible window film and the window. The elongated elements 100 are installed by attachment along all of the window frame sides 21 to form the completed window frame assembly 100. The frame assembly 100 then covers the orthogonal and adjacent portions of the window frame 20 and at least a perimeter of the window glazing 1 that is not completely covered by the flexible window film 200. After installation as shown in FIG. 1D, the window 10 with an attached covering film 200 comprises a glazing surface 1 installed in a window frame 10, the window frame 10 having inward extending sides 11 disposed orthogonal to and generally surrounding the glazing surface 1.

The window film 200 may include various coatings, patterns, pigments, UV or IR reflective or absorbing materials, as well as light re-directing optical structures. The light re-directing optical structures on one or more of the internal and external facing surfaces, as well as internally. The purpose of such window films is to modify the light entering the building interior and/or the interior or external interior appearance.

The elongated elements 110 are configured to allow for the free evaporation and elimination of moisture by diffusion, primarily by egress at the window film 200 edge. The elongated elements 110 are optionally attached to each other before or after installation. However, they are preferred installed with onto frame side 21 and the window film 200 using an attachment means such as a pressure sensitive adhesive 120 and 120'. The pressure sensitive adhesive 120 and 120' is preferably applied in discrete bands that provide gaps or channels 130 for moisture to evaporate and escape from the edge of the glazing surface 1 and the window film 200 edge.

The pressure sensitive adhesive 120 and 120' may be pre-applied to the elongated elements 110 or to the installed window film 200, such as using adhesive tape with a release film on both sides.

FIG. 4-8 further illustrates alternative and preferred embodiments of the window frame 100 components comprising a plurality of elongated member 110 that form the frame system 1000 upon installation with the window film 200. As with the kit of FIG. 1A, they comprise a plurality of elongated member 110 having 2 orthogonally disposed sides 111 and 112. The elongated members 110 have at least one side opposite sides 111 and 112, these one or more sides, such as beveled side 123 face the interior of the building, and may have any closed shape. The pressure sensitive adhesive 120, or an alternative attachment means, is disposed on at least one of the orthogonal sides 111 and 112, but preferably both. The size and cross-sectional shape of the elongated elements 111 are generally selected with a sufficient height to cover the bead of adhesive or caulking 124, with the minimum interference with the window film 200. However, the shape can also conform or complements the window frame 20.

In the embodiments of FIGS. 4 and 6-8, the channels 130 are provided by lateral gaps in the adhesive 120' and/or 120. The gaps can be in either or both the adhesive 120 and 120'. The direction of moisture egress through these channels is indicated by the double headed arrow in these Figures, and is generally referred to herein as channels. The elongated member 110 has a shape and dimension in cross section sufficient to extend beyond and obscure the interior view of the bead 124 and the edge 201 of the trimmed film 200.

Figure 4:
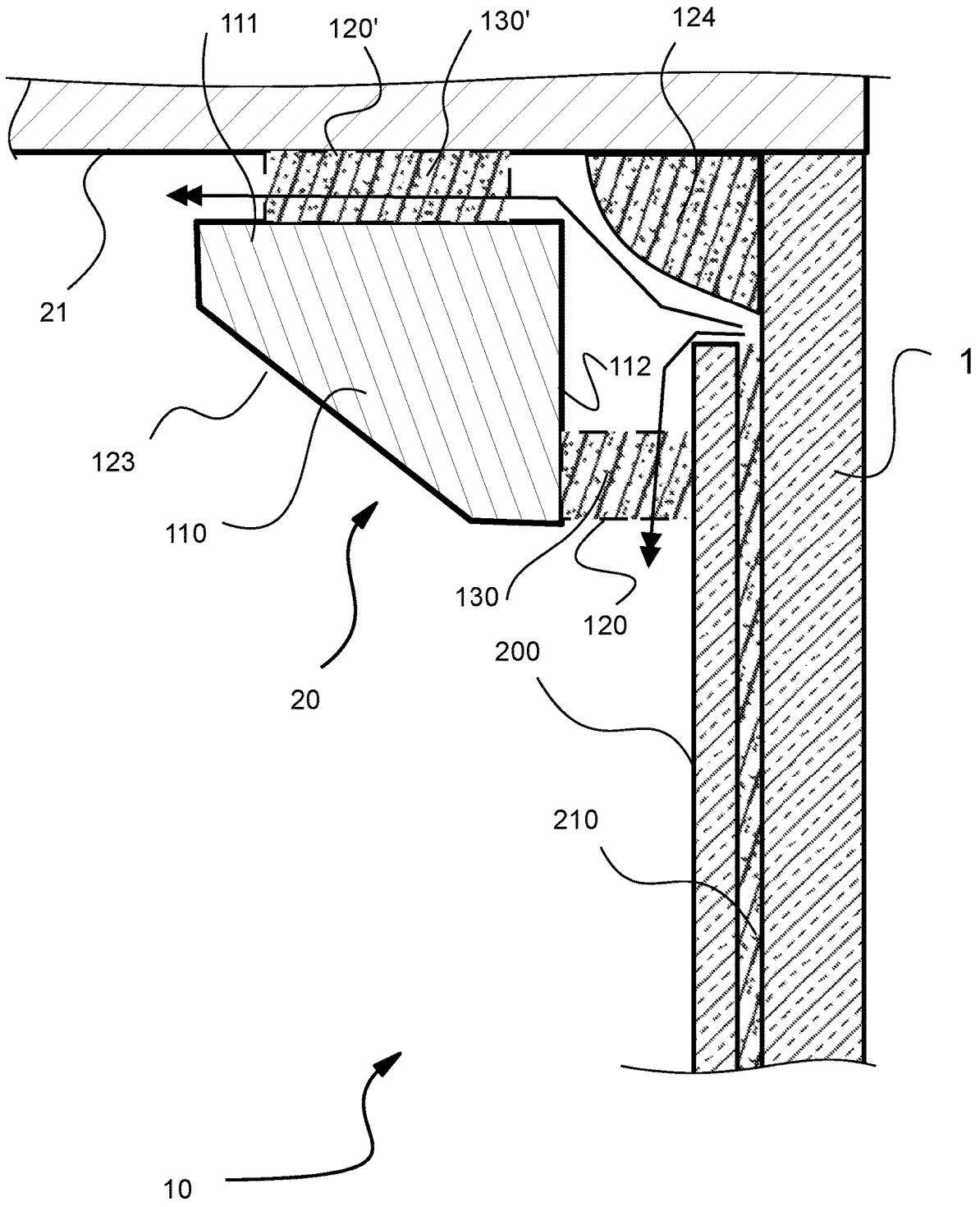
FIG. 4 is side cross-sectional elevation view of the window and frame after the kit of FIG. 1A has been applied, taken at the section line indicated in FIG. 1D.

The embodiment of the elongated element 110 of FIG. 4 has 5 sides, included a front beveled side 123. The adhesive 120 on side 112 is of a sufficient width to space the rear surface of the elongated member 110 away from the adhesive bead 124, as well as height to cover the exposed edge of the window film 200. The adhesive 120' connecting the side 111 with the window frame side 21 has gaps to define channels 130 for water vapor egress. It is preferable that the adhesive layer 120 that attached member side 112 to the window film 200 is discontinuous to provide channels 130, as the gaps will not be visible. It is more preferable that the adhesive 120' is relatively thin or continuous so that gaps, if any will not be visible.

Figure 5:
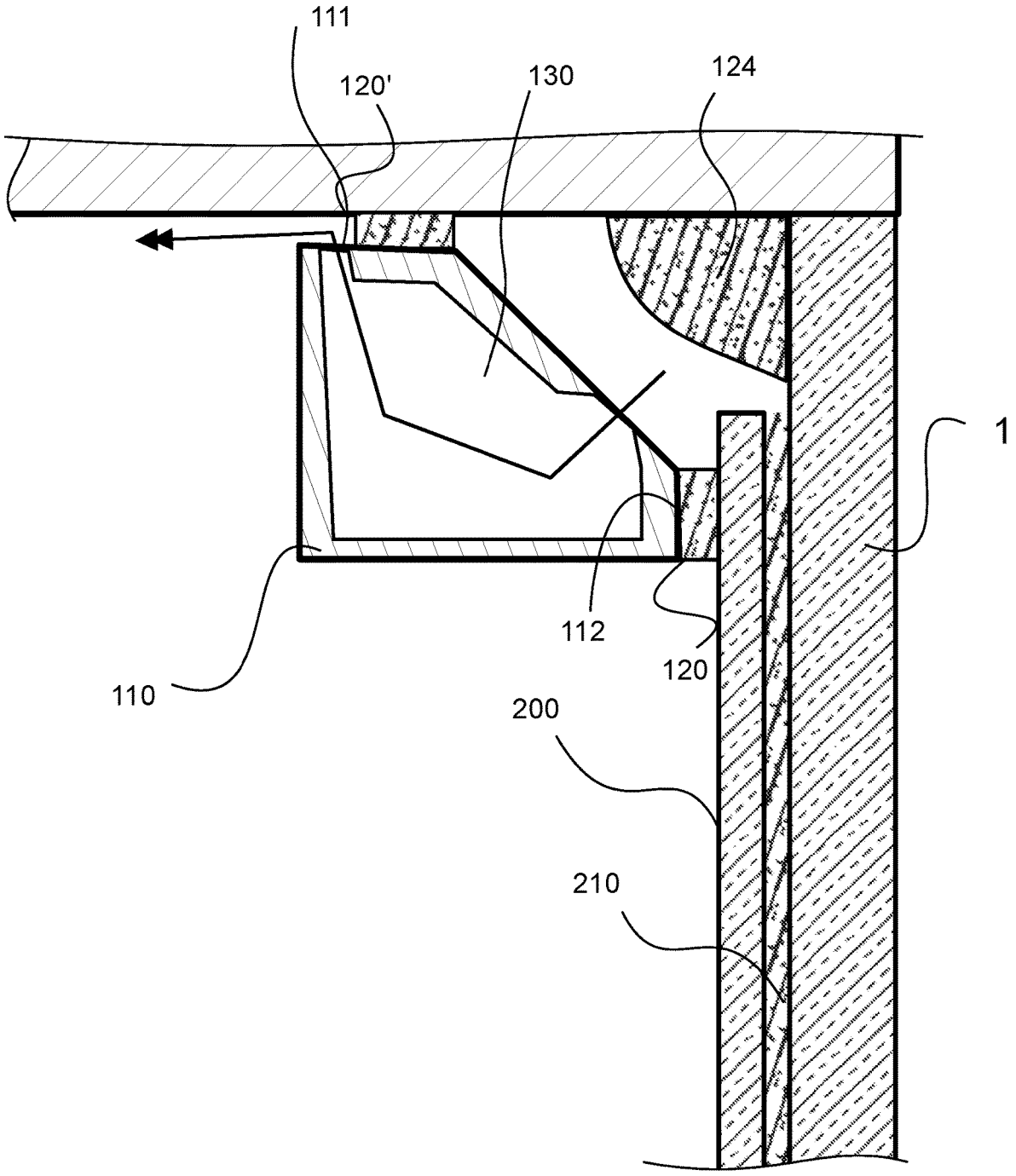
FIG. 5 is side cross-sectional elevation view of the window and frame after an alternative embodiment of the kit of FIG. 1A has been applied, taken at the section line indicated in FIG. 1D.

As shown in FIG. 5, elongated elements 110 can have a hollow core so the channels 130 may extend though an interior portion of the elongated member 110. It should be noted in this embodiment that the exit hole for vapor along channel 130 is in front of the upper adhesive layer 120'. This allows the adhesive layer 120' to be very thin and optionally continuous to eliminate the appearance of a gap between the window frame side 21 and the elongated element 110. The adhesive 120' can also be relatively much thicker than needed for remaining attached to the window frame 21, such as to accommodate imperfections and unevenness in the window frame 20 finish on the frame side 21.

Figure 6:
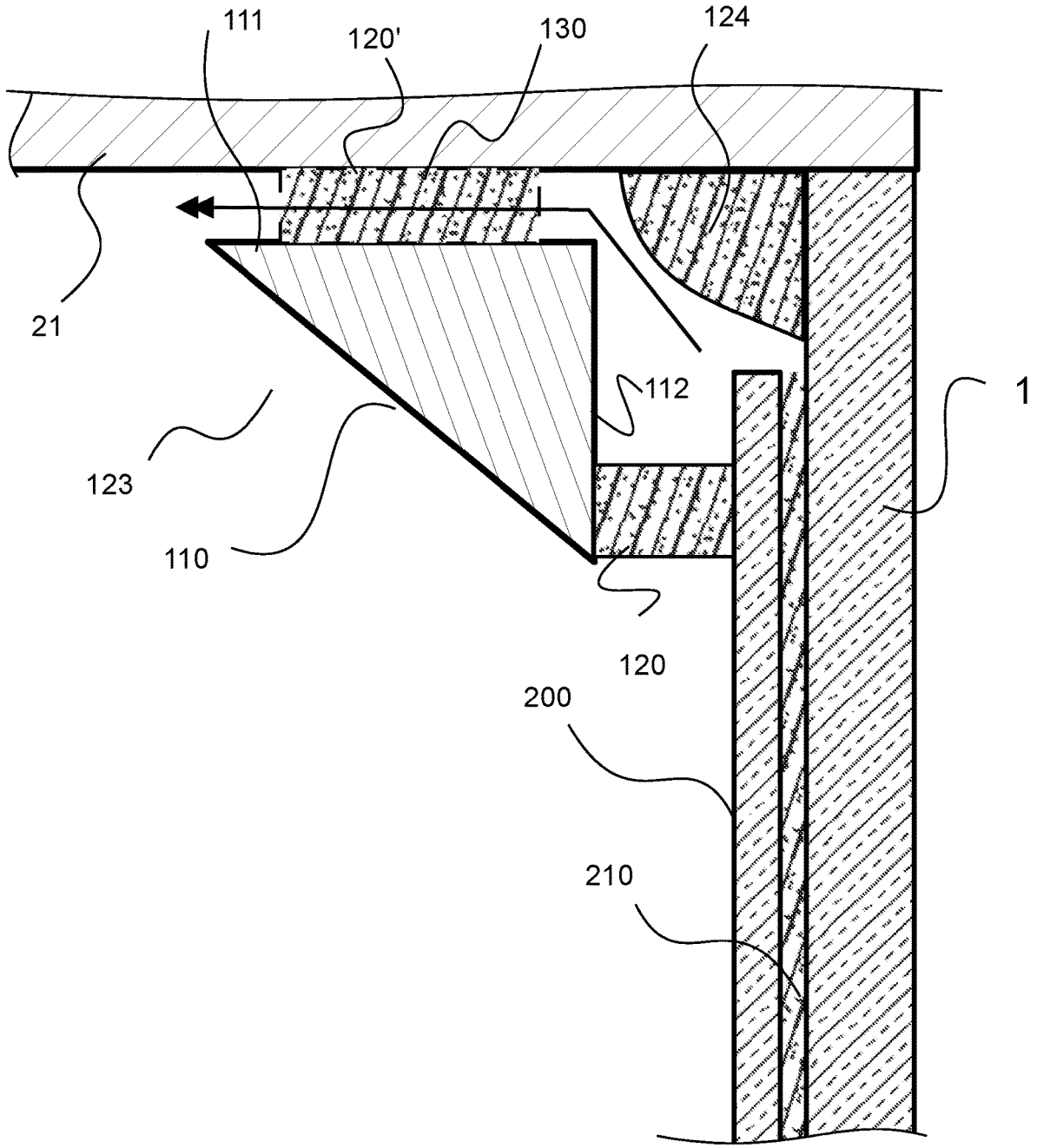
FIG. 6 is side cross-sectional elevation view of the window and frame after another alternative embodiment of the kit of FIG. 1A has been applied, taken at the section line indicated in FIG. 1D.
Figure 7:
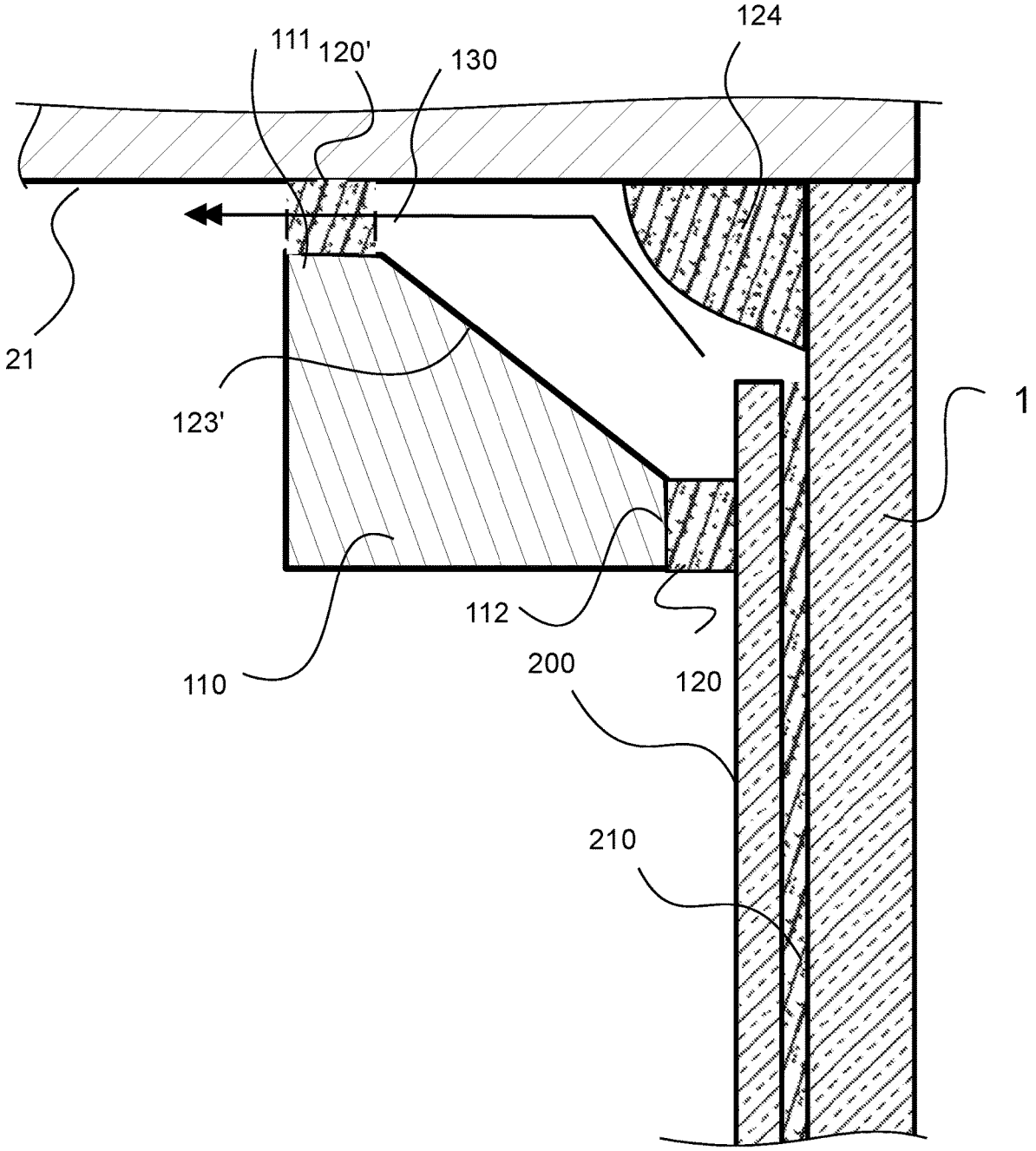
FIG. 7 is side cross-sectional elevation view of the window and frame after a different alternative embodiment of the kit of FIG. 1A has been applied, taken at the section line indicated in FIG. 1D.

The embodiment of the elongated member 110 in FIG. 6 has a triangular shaped cross-section, whereas the embodiment of FIG. 7 has 5 sides like the embodiment of FIGS. 4 and 5, but with the beveled side 123' facing the adhesive bead 124. The beveled side 123' essentially provides a space for the adhesive bead 124 and allows a very close spacing of the elongated member 110 to the window film 200. The layer of adhesive 120 need only have sufficient thickness to provide adequate adhesion and ease of installation.

Figure 8:
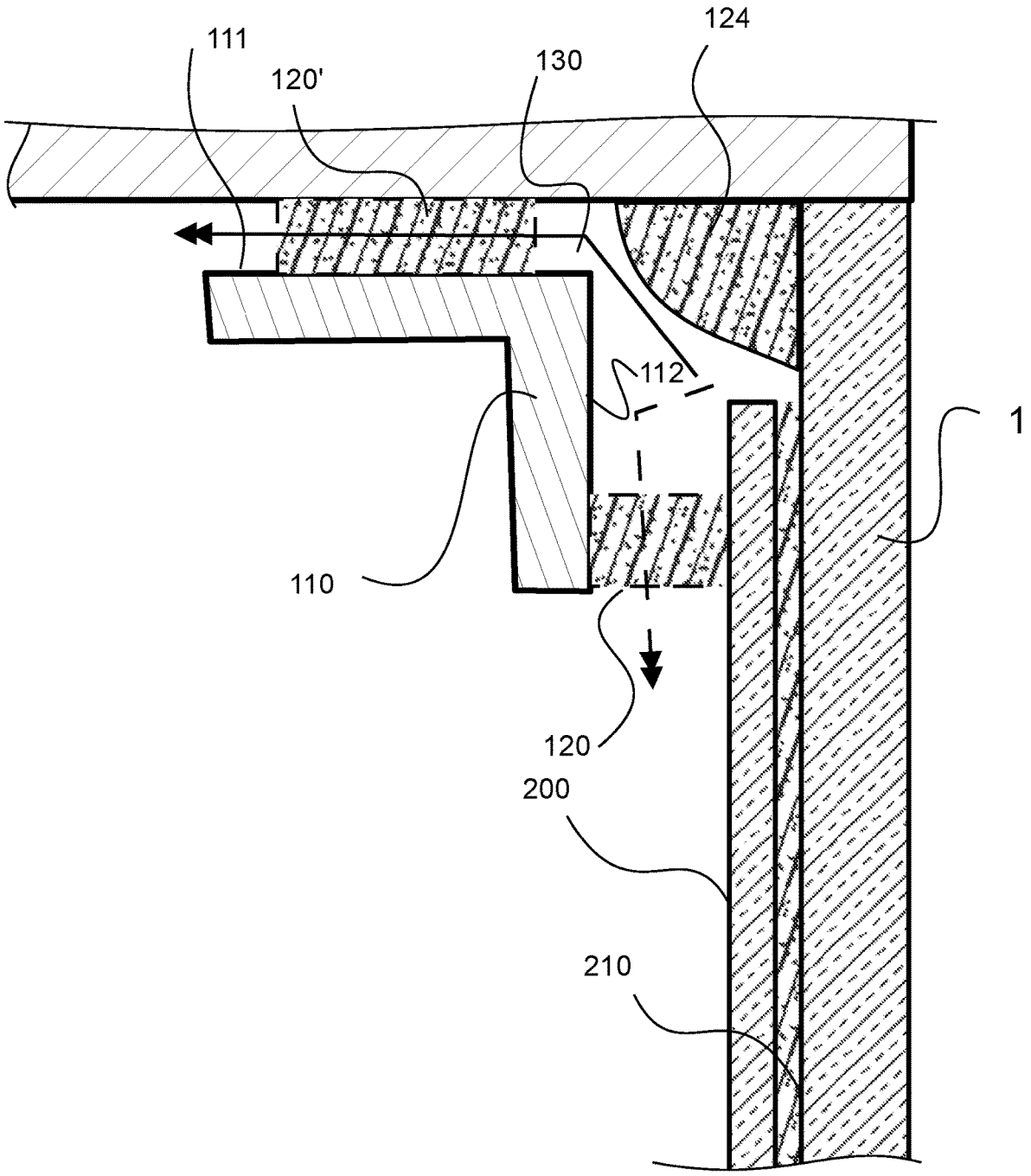
FIG. 8 is side cross-sectional elevation view of the window and frame after another alternative embodiment of the kit of FIG. 1A has been applied, taken at the section line indicated in FIG. 1D.

FIG. 8 illustrates another embodiment of the elongated element 110 having a—L-shape cross-section. The thickness of the adhesive 120 spaces the elongated member 110 away from the adhesive bead 124.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

Such alternatives, modifications, and equivalents may include as non-limiting examples, alternative cross-section shapes for elongated element 110, such as with one or more sides between sides 112 and 111 disposed at any angle, including 90 degrees for a square or rectangular side, as well as any aspect ratio for the shapes illustrated. The cross-section may have fanciful shapes to provide decorative functionality. The elongated element 110 can also have different cross-sectional shapes to accommodate a shape of the window frame side 21 in factory installed window frames.

The ends of the elongated members 110 can have miter cuts at 45 degrees, as illustrated in FIG. 1B-D, or any other shape. The elongated members 110 can be supplied in continuous length and cut to size, including miter or other shape side cuts on the installation site.

In addition, while the pressure sensitive adhesive 120 and 120' is a preferred embodiment of an adhesive means for connecting the elongated elements 110 and the window frame sides 21, due to the compatibility with a wide variety of window frame 20 materials. Other adhesive means that can be used with or of the adhesive 120' include magnetic attachment means, such as magnetic strips or discrete magnetic in the case of a ferromagnetic window frame 20, or a ferromagnetic or magnetic strip applied to the window frame side 21, when the elongated member 110 is ferromagnetic, magnetic or contains embedded magnets. The embodiment of FIG. 5 may be used with a magnetic strip or discrete magnets placed inside the inner cavity with a ferromagnetic frame.

It should also be appreciated that while adhesive means may be desirable or easier to apply to all of the elongated member 110 that form frame 100, if these members are attached to each other before, during or after they are affixed to cover the edges of the window film 200, then an adhesive means may be limited. Such adhesive or attachment means may then include any form of clips, screws, nails, pin, hook and loop type fasteners, such as "VELCRO" brand tapes, and the like.

I claim:

1. A window with an attached window covering film, the window comprising:

a) a glazing surface installed in a window frame, the window frame having inward extending sides disposed orthogonal to and generally surrounding the glazing surface, b) the window covering film installed over the glazing surface being attached with an adhesive material disposed between at least a portion of the window covering film and the glazing surface in which the window covering film has a perimeter that extends proximal to the window frame, c) a window interior framing component that comprises;

i) a plurality of elongated members disposed adjacent to the window frame in which one or more member of the plurality are attached to one of the window covering film and the glazing surface to cover the perimeter of the window covering film and an adjacent portion of the glazing surface not covered by the window covering film, each elongated member of the plurality having a first side and a second side that is coupled to and orthogonally disposed to the first side in a first direction, in which the first and second sides extend in a direction of a primary axis of the elongated member, ii) an adhesive means disposed on at least one of the first and second sides of the one or more of the elongated members, the adhesive means extending along the at least one of the first and second sides in the direction of the primary axis of the elongated member attaching the elongated member to one of the glazing surface and window frame, ii) a plurality of channels for vapor egress from an edge of the window covering film and the adjacent portion of the glazing surface not covered by the window film to an exterior of the window framing component.

2. The window with an attached window covering film according to claim 1 wherein the window covering film is a daylighting film.

3. The window with an attached window covering film according to claim 2 wherein the adhesive means is a pressure sensitive adhesive.

4. The window with an attached window covering film according to claim 1 wherein the plurality of channels for vapor egress are formed by gaps between the adhesive means disposed on at least one of the first and second sides of the one or more of the elongated members of the plurality.

5. The window with an attached window covering film according to claim 1 wherein the adhesive means extends continuously on at least one side of the at least one elongated members.

6. The window with an attached window covering film according to claim 1 wherein the plurality of channels for vapor egress are formed in at least one or more elongated members of the plurality.

7. The window with an attached window covering film according to claim 5 wherein the plurality of channels for vapor egress are formed in at least one of the elongated member of said plurality of elongated members in which the adhesive means extends continuously on at least one side thereof.

8. The window with an attached window covering film according to claim 1 wherein the adhesive means is disposed on the first and the second side of the at least one elongated member of the plurality to connect a side of the elongated member to the window frame.

9. The window with an attached window covering film according to claim 1 wherein the adhesive means is a pressure sensitive adhesive strip.

10. The window with an attached window covering film according to claim 9 wherein the pressure sensitive adhesive strip has a series of gaps to define channels for moisture egress.

11. The window with an attached window covering film according to claim 1 wherein the adhesive means are a magnetic attachment means.

12. The window with an attached window covering film according to claim 1 wherein each elongated member has a third side coupling the first side to the second side that is disposed at an acute angle to both the first and second sides to provide a beveled corner to accommodate an adhesive bead placed at a margin of the glazing surface and the window frame.

13. A window with an attached window covering film, the window comprising:

a) a glazing surface installed in a window frame, the window frame having inward extending sides disposed orthogonal to and generally surrounding the glazing surface, b) the window covering film installed over the glazing surface being attached with an adhesive material disposed between at least a portion of the window covering film and the glazing surface in which the window covering film has a perimeter that extends proximal to the window frame, c) a window interior framing component that comprises;

i) a plurality of elongated members disposed adjacent to the window frame in which one or more member of the plurality are attached to one of the window covering film and the glazing surface to cover the perimeter of the window covering film and an adjacent portion of the glazing surface not covered by the window covering film, each elongated member of the plurality having a first side and a second side that is coupled to and orthogonally disposed to the first side in a first direction, in which the first and second sides extend in a direction of a primary axis of the elongated member, ii) an adhesive means disposed on at least one of the first and second sides of the one or more of the elongated members, the adhesive means extending along the at least one of the first and second sides in the direction of the primary axis of the elongated member for attaching the elongated member to one of the glazing surface and window frame, ii) a plurality of channels for vapor egress from an edge of the window covering film covered by the one or more elongated members in which said plurality of channels for vapor egress extend in a direction that is transverse to the primary axis of the elongated member, wherein each elongated member has a third side coupling the first side to the second side that is disposed at an acute angle to both the first and second sides to provide a beveled corner to accommodate an adhesive bead placed at a margin of the glazing surface and the window frame, in which a cavity in the at least one elongated member of the plurality is disposed between the first, second and third sides and at least two of the first, second and third side have openings to the cavity which provide the channels for vapor egress.

* * * * *